United States Patent [19]

Ballerin et al.

[11] Patent Number: 4,559,918

[45] Date of Patent: Dec. 24, 1985

[54] BALL-THROWING DEVICE WITH BALL THROWING HEADS AND BALL CONVEYING SYSTEM INCLUDING Y-JUNCTION

[75] Inventors: Jean-Paul Ballerin, Chatou; Alexandre Georgelin, Bois-Colombes; Edmond Ballerin, Chatou, all of France

[73] Assignee: Faiveley Entreprises, Saint-Ouen, France

[21] Appl. No.: 486,304

[22] Filed: Apr. 19, 1983

[30] Foreign Application Priority Data

May 12, 1982 [FR] France ..... 82 08237

[51] Int. Cl.[4] ..... A63B 69/00; F41B 15/00

[52] U.S. Cl. ..... 124/78; 124/41 R; 124/51 A; 124/81; 273/30

[58] Field of Search ..... 273/30, 26 D, 29 A; 124/59, 78, 51 A, 41 R, 41 C, 50, 53, 56, 81, 49, 77

[56] References Cited

U.S. PATENT DOCUMENTS

| | | | |
|---|---|---|---|
| 1,733,394 | 10/1929 | Bible et al. | 124/50 X |
| 2,508,461 | 5/1950 | Lemon | 273/30 |
| 2,918,915 | 12/1959 | Doeg | 124/50 X |
| 3,306,613 | 2/1967 | Mainers | 273/26 D |
| 3,538,900 | 11/1970 | Samuels | 124/78 |
| 3,724,438 | 4/1973 | Brandt | 124/59 |
| 3,734,075 | 5/1973 | Staples | 124/78 |
| 3,774,584 | 11/1973 | Paulson | 124/78 |
| 3,777,732 | 12/1973 | Holloway et al. | 124/78 |
| 3,999,754 | 12/1976 | Krzysztofiak et al. | 124/56 X |
| 4,002,336 | 1/1977 | Beaver et al. | 124/56 X |
| 4,077,386 | 3/1978 | Berliner | 124/78 |
| 4,086,903 | 5/1978 | Scott | 124/78 |
| 4,269,163 | 5/1981 | Feith | 124/77 |
| 4,299,383 | 11/1981 | Yuasa | 124/78 X |

FOREIGN PATENT DOCUMENTS

| | | | |
|---|---|---|---|
| 2917610 | 11/1980 | Fed. Rep. of Germany | 124/78 |
| 52-39430 | 3/1977 | Japan | 124/78 |
| 54-46636 | 4/1979 | Japan | 273/29 A |
| 7605989 | 12/1977 | Netherlands | 124/78 |

*Primary Examiner*—Richard T. Stouffer

*Attorney, Agent, or Firm*—Young & Thompson

[57] ABSTRACT

Balls such as table tennis balls or tennis balls are continuously fed to two pairs of adjacent flanged rollers of a ball-throwing head by a blower and two transfer ducts. Balls hit by the player are collected by a net and a trough, then fed back to the head. The rollers have separately variable speeds of rotation, a gap being provided between each pair of rollers and adapted to the diameter of the balls. The balls are directed alternately into each transfer duct, the opening of which is located opposite to each gap.

3 Claims, 12 Drawing Figures

FIG. 5
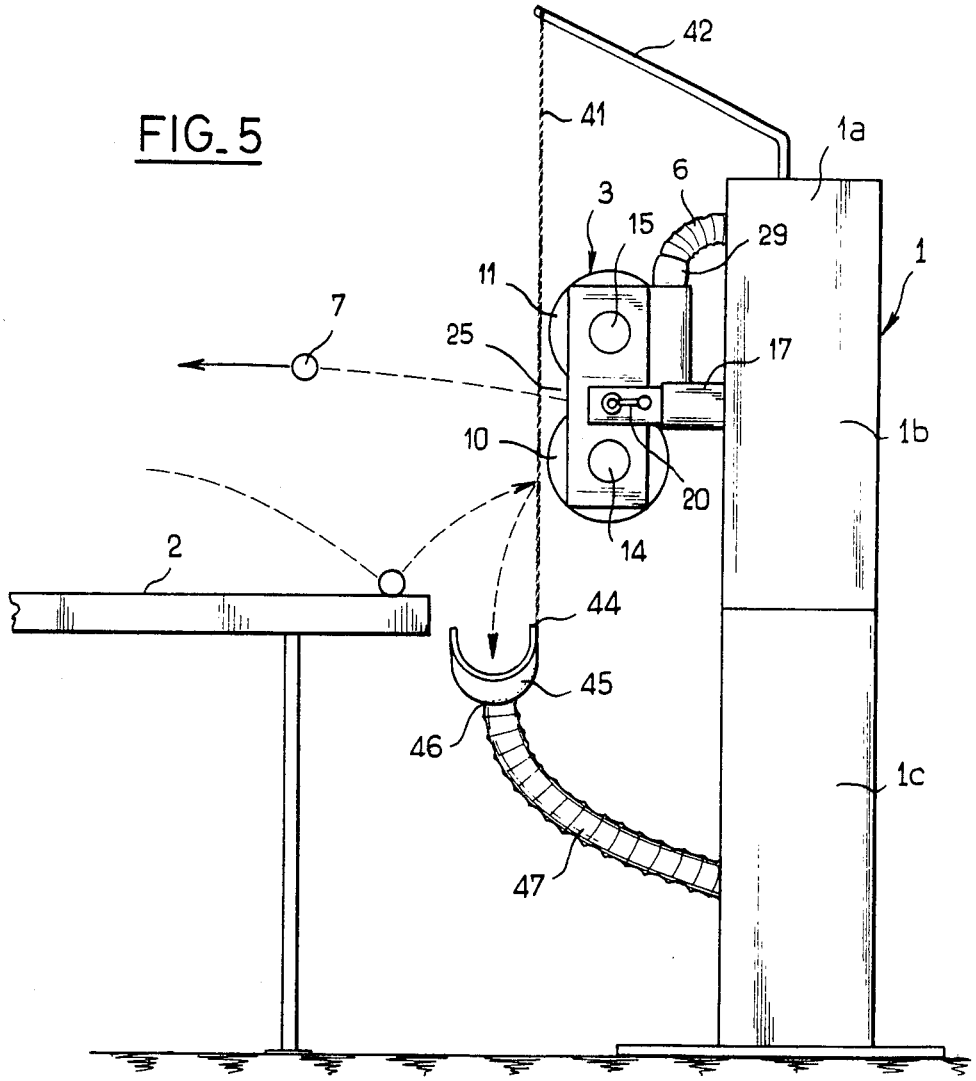
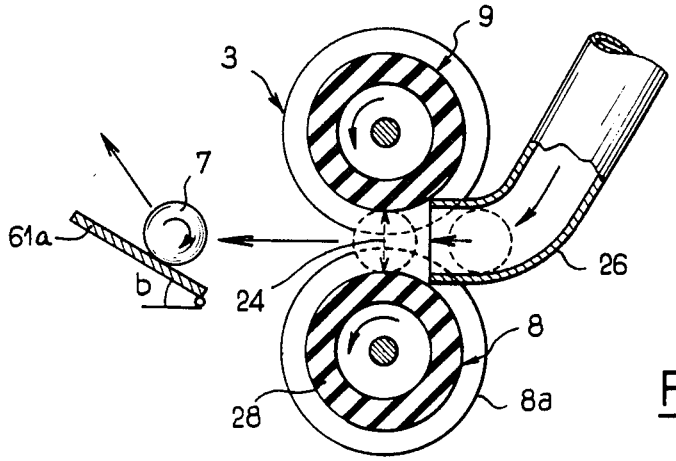
FIG. 6

FIG_11
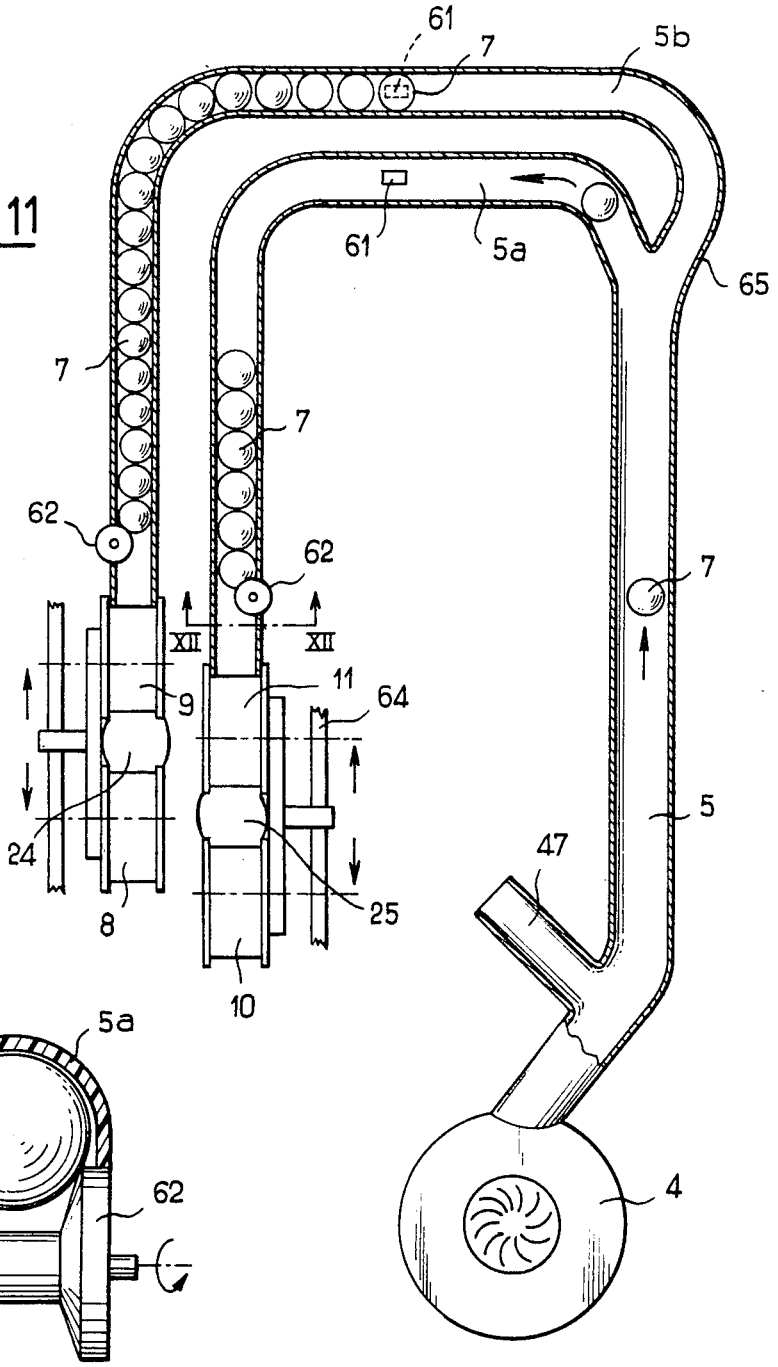
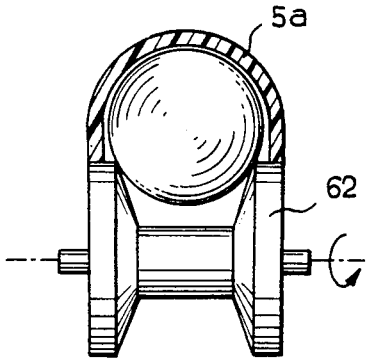
FIG_12

BALL-THROWING DEVICE WITH BALL THROWING HEADS AND BALL CONVEYING SYSTEM INCLUDING Y-JUNCTION

This invention relates to a device for throwing balls on a game area and in particular onto a table tennis table.

Known ball-throwing devices for table tennis comprise a throwing head placed at one end of the table, that is, the end remote from the player's position.

Said throwing head throws the balls successively onto the table, the player receives them with his paddle and returns them to a receiving screen or net placed above the table opposite to the throwing head.

Said screen or net collects the balls which are then again directed to the throwing head.

The throwing head of known devices comprises one or two rotating rollers placed opposite to a ball supply duct. As they rotate, said roller or rollers collect each ball in turn and project them towards the playing area. The balls are propelled from a storage container into the above-mentioned duct, usually by means of an air blower or under the action of gravity.

The devices mentioned in the foregoing are highly advantageous since they enable a single player to practice alone without requiring a partner or coach and without any need to move continually from one point to another in order to pick up balls.

The conditions of throwing of balls can be modified by varying the speed of rotation of the rollers of the throwing head and by modifying the direction in which the balls are thrown.

In the event that the throwing head is provided with two rollers mounted one above the other, these rollers can be driven in rotation at different speeds in order to project the ball with "top-spin" or "cut" effects which are comparable to those produced when the ball is hit by a player's paddle.

In known devices of the most advanced designs, it is thus endeavored to achieve ball-throwing conditions with a degree of variety almost as great as when two players are playing opposite to each other.

There is, however, a major disadvantage attached to known devices. By reason of the inertia of the throwing-head rollers, it is in fact impossible to produce an instantaneous modification of ball-throwing conditions. Thus it is not possible to throw balls at a rate less than or equal to one ball per second while producing different projection speeds and effects in the case of each ball. Devices of this type consequently fail to reproduce the real conditions of the game of table tennis and, in the final analysis, are in no way likely to take a player by surprise with a ball thrown under very different conditions from those of the previous ball. As a result of this shortcoming, players cannot be confronted with sudden and varied difficulties, with the result that pupils or beginners cannot make progress as readily or as rapidly as would be the case when playing with a coach or an experienced player.

The aim of the present invention is to overcome the drawback mentioned above by providing a device which permits perfect reproduction of the real conditions of hitting table tennis balls or tennis balls, for example, especially by permitting instantaneous modification of the conditions of throwing of these balls.

The ball-throwing device contemplated by the invention comprises means for continuously conveying balls to a ball-throwing head provided with at least one roller which is driven in rotation and is capable of taking each ball in succession and projecting them towards the playing area and means for recovering the balls hit by the player and then again conveying them to the ball-throwing head.

The distinctive feature of the device according to the invention lies in the fact that the ball-throwing head comprises two pairs of rotating rollers placed in side-by-side relation, that means are provided for individual adjustment of the speed of rotation of each roller, that the rollers of each pair are spaced apart in order to form a gap which is adapted to the diameter of the balls and thus to permit each ball which is engaged within said gap to come into contact simultaneously with both rollers of each pair, that a duct for feeding balls has its opening opposite to each gap aforesaid, and that means are provided for conveying balls into the two above-mentioned ducts in alternate succession.

By virtue of said device, the balls can be directed alternately into either of the gaps formed between each pair of rollers.

During the time taken to convey a ball to one pair of rollers, it is possible to modify the speed of rotation of the rollers of the other pair, with the result that the following ball taken by said other pair of rollers can be thrown under conditions which are different from those of the previous ball. The conditions of throwing of a ball can thus be modified instantaneously without being hindered by the inertia of the rotating rollers.

The result thereby achieved is that a player can be confronted with difficulties of a varied nature as in the case of a game played with an experienced player or with a coach. The game of table tennis or tennis is thus made much more attractive for the player.

In an advantageous embodiment of the invention, the ball-throwing head is mounted so as to be capable of pivotal displacement about a substantially vertical axis and is connected to means whereby the ball-throwing head is permitted to carry out continuous sweeping of a predetermined angular sector.

The sweeping motion of the head can take place at more or less high speed, said speed and the angle of sweep being modifiable according to the degree of skill of the player or according to the difficulties to be put in the player's way.

In a preferred embodiment of the invention, the means for conveying the balls in alternate succession into the two ducts which open opposite to gaps formed between the rotating rollers comprise a main duct connected at one end to a blower and at the other end to a Y-junction which is connected to the ducts aforesaid. Provision is made downstream of said Y-junction for a member located opposite to each duct and capable of engaging in said ducts in alternate sequence in order to prevent the balls from passing.

The time which elapses between the positions of engagement and withdrawal of said member can be modified according to the rate of throwing of balls which it is desired to obtain.

Other features of the invention will be more apparent upon consideration of the following description and accompanying drawings, wherein:

FIG. 5 is a side view of the device in accordance with the invention and placed opposite to a table tennis table;

FIG. 6 is a sectional view of two superposed rotating rollers of the ball-throwing head, which is taken at right angles to the axes of said rollers and also shows the corresponding ball-feeding duct in a fragmentary part-sectional view;

FIG. 11 is a schematic view of an alternative embodiment of the ball-propelling and throwing means;

FIG. 12 is a sectional view to a larger scale and taken along the plane XII—XII of FIG. 11.

Figure 1:
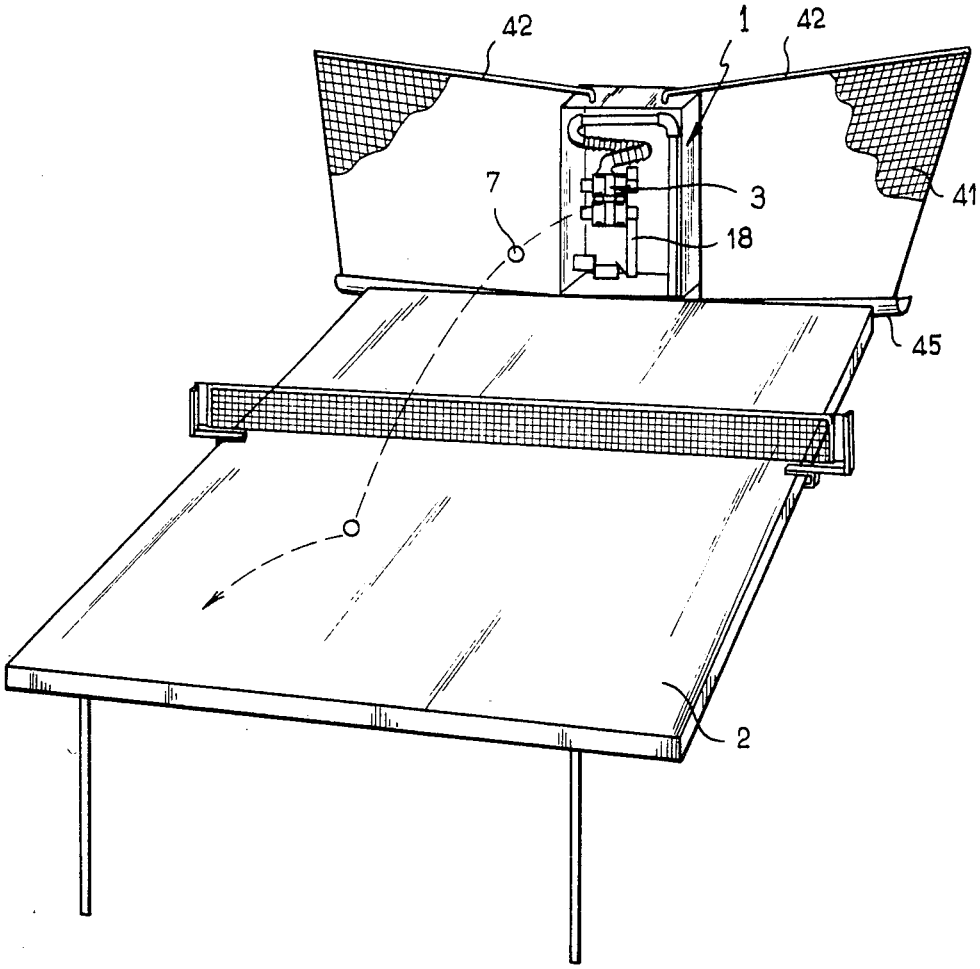
FIG. 1 is a perspective view of a table tennis table equipped with a ball-throwing device in accordance with the invention.

In the embodiment of FIGS. 1 to 5, the ball-throwing device housed within a box 1 placed at one end of a table tennis table 2 mainly comprises a ball-throwing head 3, an air blower 4 (shown in FIG. 2) which is connected to ducts 5, 6 for continuously conveying the balls 7 to the ball-throwing head 3, and means for recovering the balls 7 hit by the player and then again conveying them to the ball-throwing head 3.

Figure 2:
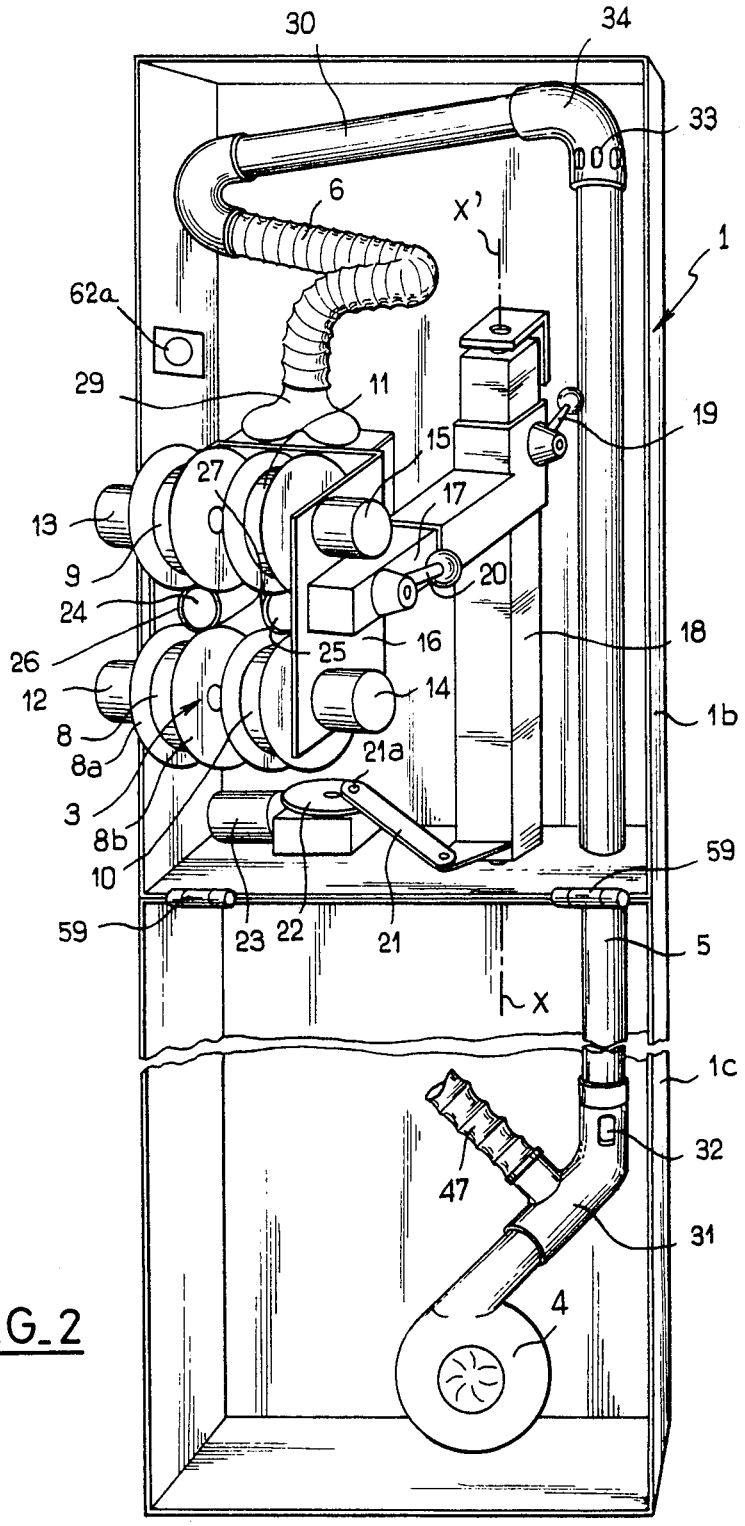
FIG. 2 is a perspective view of the ball-throwing head and of the ball-propelling means which are housed within a box.

In accordance with the invention (as shown in FIGS. 2 and 6), the ball-throwing head 3 is provided with two pairs of rollers 8, 9; 10, 11 placed side by side substantially in two parallel and vertical planes. Each roller is driven in rotation by a motor 12, 13; 14, 15. The operating speeds of said motors can be varied individually, for example by means of potentiometers or the like.

Said rollers 8 to 11 and said motors 12 to 15 are carried by a support bracket 16 fixed at the end of an arm 17 which is slidably mounted on a column 18.

Figure 4:
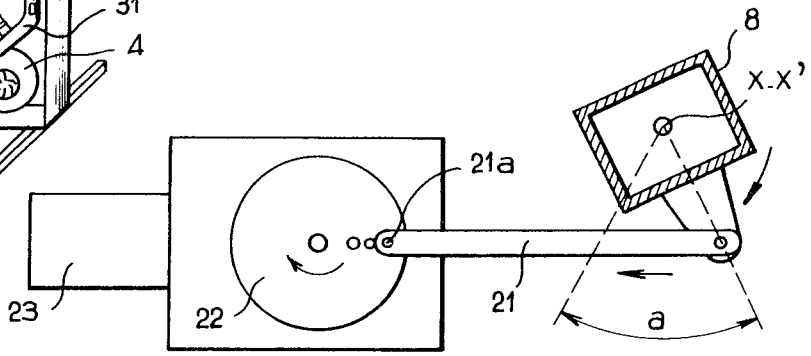
FIG. 4 is a plan view of the means for controlling the angular sweep of the ball-throwing head.

The length of the arm 17 as well as the height at which said arm is fixed on the column 18 can be adjusted by actuating locking levers such as those designated by the reference 19. The bracket 16 which supports the rollers 8 to 11 is articulated with respect to the arm 17 so as to permit of angular displacement of said bracket about a horizontal axis, with the result that the inclination of the ball-throwing head 3 with respect to a horizontal plane can be adjusted. The locking lever 20 serves to secure said head in the desired angular position. The column 18 is mounted so as to be capable of pivotal displacement about a vertical axis X-X' and is connected to a link-arm 21 (as shown in FIGS. 2 and 4), said link-arm being pivotally attached to a disk 22 which is driven in rotation by a motor 23. This arrangement permits continuous sweeping of the ball-throwing head 3 through a predetermined angular sector a (as shown in FIG. 4).

Said angular sector a can be modified by adjusting the position of the point 21*a* of pivotal attachment of the link-arm 21 to the disk 22.

The rate of sweep of the ball-throwing head 3 can be modified by adjusting the speed of rotation of the motor 23.

In the embodiment shown in FIGS. 2 and 6, the rollers 8 to 11 of each pair are spaced apart in order to form a gap 24, 25 which is adapted to the diameter of the balls 7 and thus to permit each ball which is engaged within said gap 24 or 25 to come into contact simultaneously with both rollers of each pair as indicated in FIG. 6.

A duct 26, 27 for feeding the balls 7 has its opening opposite to each gap 24, 25.

Moreover, each roller 8 to 11 is provided with two lateral flanges such as those designated by the references 8*a*, 8*b*. Said flanges are formed of flexible material and define on the periphery of each roller a U-section channel which is adapted to the diameter of the balls 7.

Furthermore, said rollers 8 to 11 are each fitted with a cylindrical shell 28 of rubber or any other elastic material which affords a relatively high coefficient of friction with the balls 7.

Preferably, the height of the gaps such as the gap 24 formed between the cylindrical shells 28 of two adjacent rollers 8, 9 or 10, 11 is slightly smaller than the diameter of the balls 7, thus causing a slight compression of the cylindrical shells 28 as the balls pass. This slight compression is conducive to adhesion between the elastic shells and the balls, thus increasing the efficiency of projection of the balls.

The ducts 26, 27 which feed said balls 7 in alternate sequence either between the rollers 8, 9 or between the rollers 10, 11 communicate with a main duct 29 which is connected to a flexible hose 6. Said flexible hose is in turn connected to a vertical duct 5 by means of a transverse tube 30 of transparent material (as shown in FIG. 2).

The air blower 4 is connected to the vertical duct 5 by means of an elbow 31 provided with an adjustable vent 32. Similarly, adjustable vents 33 are provided in the elbow 34 which serves to connect the duct 5 to the transparent tube 30.

The internal diameter d of the ducts for conveying the balls 7 to the ball-throwing head 3 is larger than the diameter of the balls, with the result that these latter are propelled by blowing and not by piston effect. On the other hand, the diameter of the ducts 26, 27 at the free ends adjacent to the rollers 8 to 11 is substantially equal to the diameter of the balls 7 in order to increase the efficiency of expulsion of the balls from said ducts 26, 27. In the embodiment shown (especially in FIG. 7), the means for conveying the balls 7 alternately to either of the ducts 26, 27 which have their openings opposite to the gaps 24, 25 formed between the rollers 8, 9; 10, 11 comprise a Y-junction 35 which communicates with the flexible hose 29 and with the ducts 26, 27. A rod 36, 37 actuated by an electromagnet 38, 39 is placed opposite each duct 26, 27 downstream of said Y-junction.

Figure 7:
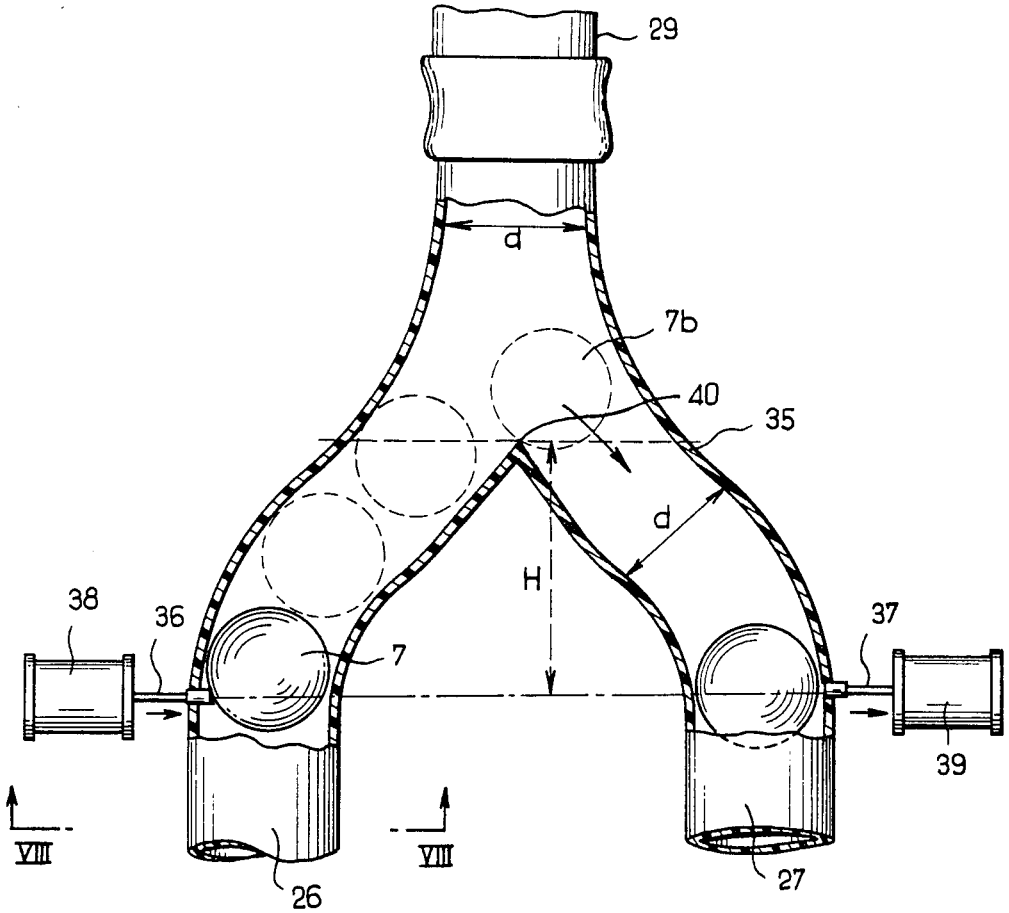
FIG. 7 is a longitudinal sectional view of the ball-feed ducts within the ball-throwing head with their respective members for distributing the balls as they travel towards the ball-throwing head.
Figure 8:
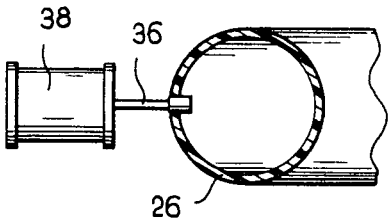
FIG. 8 is a sectional view taken along the plane VIII—VIII of FIG. 7.

Each rod 36, 37 is capable of displacement between a position in which the rod extremity projects to a slight extent within the duct 26 as shown in the left-hand portion of FIG. 7 and in FIG. 8 or within the duct 27, and a withdrawn position as illustrated in the right-hand portion of FIG. 7.

In the position shown in FIG. 7 , the balls 7 are prevented from passing into the duct 26 but are permitted to pass freely into the duct 27. Electromagnets 38, 39 are connected to means (not illustrated but of a conventional type) for controlling the alternating motion of the rods 36, 37 in order to permit the successive transfer of balls into the ducts 26, 27 at a frequency within the range of one to three balls per second, for example.

FIG. 7 also shows that the Y-junction 35 is provided at its entrance with a point 40 which prevents a ball 7*b* (shown in dashed outline) from occupying at the entrance of the Y-junction a stable position which would be liable to stop the transfer of balls. The result thereby achieved is that said ball 7*b* is obliged to engage either within the duct 26 or within the duct 27.

Furthermore, the distance H between the rods 36, 37 and the point 40 of the Y-junction is so determined as to ensure that each branch of the Y-junction cannot contain any ball which would be liable to interfere with the transfer of a ball into the other branch of said Y-junction.

Figure 3:
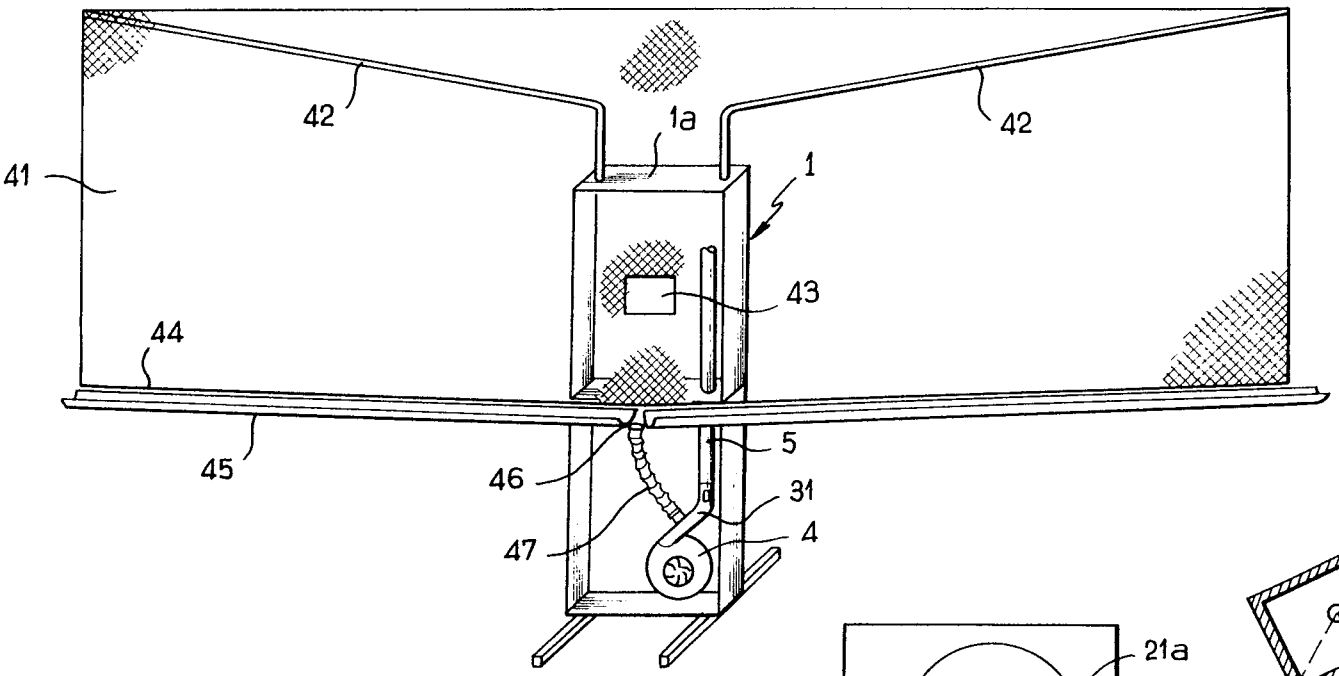
FIG. 3 is a perspective view of the box and of the means for receiving and collecting balls.

In FIGS. 1, 3 and 5, it is apparent that the means for collecting the balls 7 returned by the player comprise a net 41 stretched above the table 2 and in front of the ball-throwing head 3. Said net 41 is attached to the ends of two rods 42 which are fixed on the top portion 1*a* of the box 1. Said net 41 is provided with a central window 43 (as shown in FIG. 3) which is located opposite to the ball-throwing head 3.

Beneath the bottom edge 44 of the net 41, there extends a trough 45 which has a cross-section in the shape of a circular arc and serves to collect the balls 7. Said trough 45 has two sloping portions which are inclined towards its center. The lowest point of said trough 45, which corresponds to its mid-point, is provided with an orifice 46 for collecting balls 7, said orifice being connected by means of a flexible hose 47 to the elbow 31 which connects the air blower 4 to the vertical duct 5.

Figure 9:
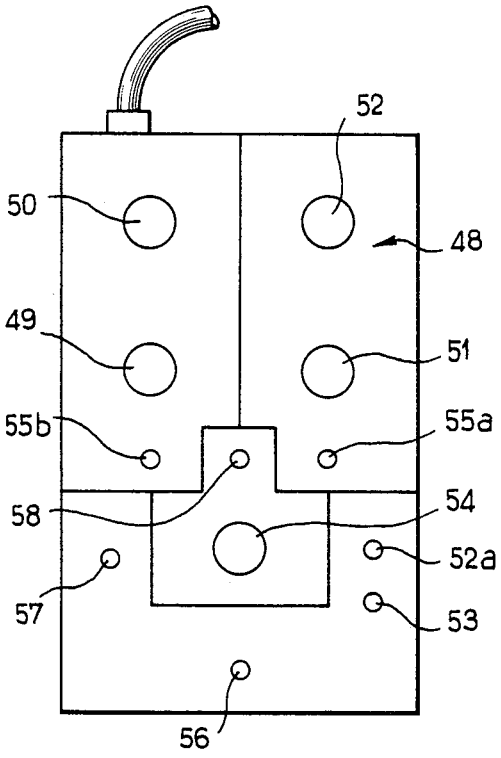
FIG. 9 is a plan view of the electric control panel of the device.

FIG. 9 illustrates the electric control panel 48 of the device in accordance with the invention. Said control panel 48 is provided with four rotatable knobs 49, 50, 51, 52 associated with potentiometers for individually adjusting the speed of rotation of the motors 12 to 15 which drive the rollers 8 to 11. Said speed of rotation can thus be set at a value within the range of 100 to 7000 revolutions per minute approximately.

A knob 52*a* serves to adjust the time-duration between the positions of engagement and withdrawal of the rods 36, 37 which are actuated by the electromagnets 38, 39. Another knob 53 serves to adjust the rate of transfer of the balls in alternate sequence to the ducts 26, 27.

The knob 54 serves to adjust the speed of rotation of the motor 23 which controls the sweeping of the ball-throwing head 3.

The switches 55*a* and 55*b* control the reversal of the direction of rotation of two out of the four motors which drive the rollers 8 to 11, thus making it possible to project the balls 7 with enhanced effects.

Additional switches 56, 57 and 58 have the respective functions of initiating the supply of electric current to the control panel 48, starting-up of the sweep motion, and initiating the supply of electric current to the circuit which controls the electromagnets 38, 39.

Figure 10:
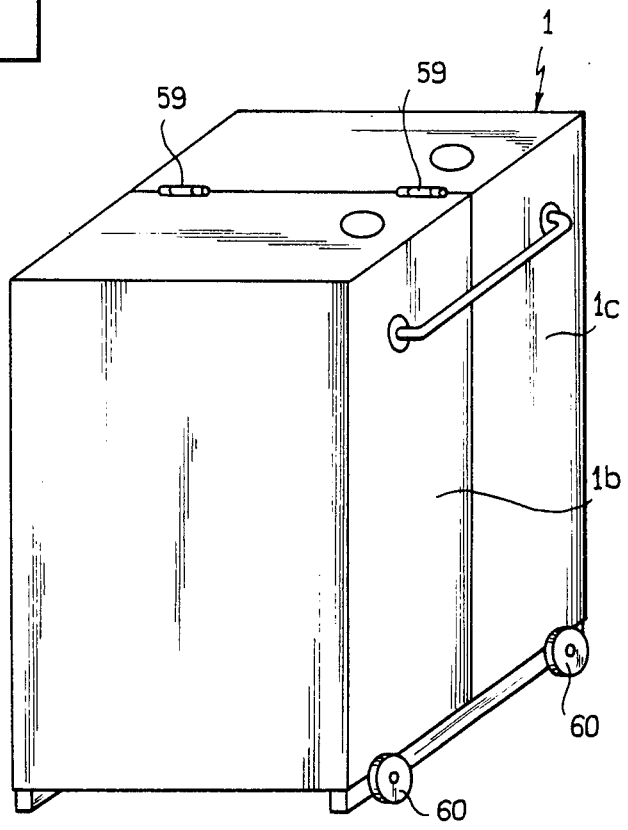
FIG. 10 is a view of the box containing the device in accordance with the invention, in the storage position.

Furthermore, as shown in FIG. 2, the parallelepipedal box 1 containing the entire device in accordance with the invention is made up of two sections 1*b*, 1*c* which are pivotally coupled by means of hinges 59. These two sections 1*b*, 1*c* can be folded back against each other as shown in FIG. 10. The box 1 in the folded state thus has a very small overall height which facilitates storage and transportation of the device. Displacement of the box 1 can be facilitated by fitting the base of said box with small wheels or castors 60.

The operation of the device which has just been described will now be explained.

After placing the device in front of the table 2 as shown in FIGS. 1 and 5, the position of the ball-throwing head 3 is adjusted by actuating the levers 19 and 20.

The different switches of the electric control panel 48 are placed in the operating position and a few balls 7 are introduced in the circuit for conveying these latter to the ball-throwing head. As soon as a ball 7 arrives within the elbow 31, said ball is propelled into the ducts 5, 30 and 6 by means of the air blower 4.

The blowing intensity can be adjusted by opening the vents 32, 33 to a greater or lesser extent. The transparent tube 30 located at the top of the box 1 serves to check the passing of the balls 7. The balls follow each other since there is no obstacle in their path and nothing to hinder their progress.

The balls 7 then penetrate into the branches of the Y-junction 35. Depending on the positions of the rods 36, 37, the displacement of which is produced in alternate sequence by the electromagnets 38, 39, the balls are successively directed either towards the duct 26 or towards the duct 27.

As they pass out of said ducts 26, 27, the balls 7 are immediately taken by the rotating rollers 8, 9 or 10, 11 and then projected onto the table tennis table 2.

The player who is at the opposite end of the table returns said ball towards the other end of the table where it bounces towards the net 41 which has the effect of damping and stopping the ball. Said ball falls into the trough 45, then rolls down to the orifice 46. The cylindrical shape of the trough 45 prevents any return towards the exterior and enables the balls to roll along the generator-lines of the cylinder. Said ball 7 is then sucked into the flexible hose 47, then again transferred to the ball-throwing head 3 by means of the blower 4.

The balls are thus expelled from the ball-throwing head at a rate within the range of one to three balls per second approximately and from each of the two pairs of rollers 8, 9; 10, 11 in alternate sequence.

During the course of a game, it is possible at any moment to modify the speed of rotation of the motors which drive the rollers 8, 9, 10, 11 in order to increase or decrease the force of projection of the balls or in order to give them "top-spin" or "cut" effects similar to the effects which can be given to a ball by means of a table tennis paddle or by means of a tennis racket. The balls can thus be caused to succeed each other at a very high frequency with projection forces and effects which differ from one ball to another.

The conditions of play can be modified instantaneously as in the case of a real game in which the player is facing an opponent whose natural aim is to put him in difficulties.

Furthermore, while the game is in progress, the rate of sweep of the ball-throwing head 3 can be modified in a continuous manner, with the result that the balls 7 are projected in variable directions, thus reproducing the conditions of a real game and making the game particularly attractive.

FIG. 11 illustrates an alternative form of construction of the means for propelling and throwing balls 7. The main duct 5 which is connected to the blower 4 is subdivided by means of a Y-junction 65 into two horizontal ducts 5*a*, 5*b* and each of these ducts has its opening opposite to a ball-throwing head which is equipped with the rollers 8, 9; 10, 11.

Each horizontal duct 5*a*, 5*b* is provided with a vent 61, the dimensions of which are smaller than the diameter of a ball 7.

As also shown in FIG. 12, a roller 62 is placed upstream of the outlets 24, 25 of the ducts 5*a*, 5*b* and is partly engaged within the duct 5*a*, 5*b*. Said roller 62 arrests the balls 7 when it is stationary and propels them one after the other when it is driven in rotation. The roller 62 is advantageously made of elastic material such as rubber and defines within the duct 5*a*, 5*b* a cross-sectional area of passage which is slightly smaller than the cross-sectional area of a ball 7.

Furthermore, in the example which is illustrated, the ball-throwing heads are each mounted on a vertical support 64 which serves to set the ball-throwing heads at different heights.

The operation of said device is as follows:

At the outset, the rollers 62 being stationary, the balls 7 which are driven forward by the blower 4 are directed indifferently into the ducts 5*a*, 5*b*. When both ducts 5*a*, 5*b* are filled with balls 7 up to the vent 61 (as in the case represented by the duct 5*b*), the balls 7 are no longer propelled since the vents 61 are each masked by a ball 7 and there is therefore no flow of air within the ducts 5*a*, 5*b*. The entire airstream is therefore discharged through the branch hose 47.

Rotation of the flexible rollers 62 can then be initiated simultaneously or successively and said rollers thus propel the balls 7 towards the ball-throwing rollers 8, 9; 10, 11. When the balls 7 are engaged between the rollers 62, said balls are driven in rotation at the same speed as the rollers 62. By modifying the speed of rotation of the balls 7, the result thereby achieved is that the balls are delivered with "top-spin" or "cut" effects.

The fact that the ball-throwing heads are located at different heights makes it possible to reproduce the real conditions of the game of table tennis or tennis.

As will be clearly understood, the invention is not limited to the example of construction described in the foregoing and a large number of modifications may accordingly be contemplated without thereby departing from the scope of the invention.

Thus, as shown in FIG. 6, a ball-deflecting plate 61*a* can be placed opposite to the ball-throwing head as shown in FIG. 6. The angle of inclination b of the deflecting plate with respect to the horizontal as well as the angle of inclination of said plate with respect to the vertical can both be adjusted according to requirements. The function of said plate 61*a* is thus to interrupt the trajectory of the balls 7 and to deflect these latter either upwards (top-spin effect) or downwards (cut effect), or towards the right or towards the left. Said plate 61*a* also makes it possible to modify the conditions of projection of the balls 7, thus imposing further difficulties on the player in order to test his or her skill.

As shown in FIG. 2, there can also be placed within the box 1 a lamp 62*a* which is placed opposite to the player and lights up as soon as a ball is at the point of delivery. The player is thus warned that a ball is about to be "served" as in the case of a real game. Provision can also be made for a number of lamps having different colors or intensities for warning the player that a ball is going to be driven with or without top-spin or cut effect, or that it will be either a deep drive or a short drive.

The operation of the device can be made fully automatic in accordance with a predetermined program by making use of preprogrammed punched cards or tapes. It is thus possible to conceive different operating programs for confronting players with increasing difficulties which are adapted to their standard of qualification.

It is readily apparent from the foregoing that the device in accordance with the invention is not limited to the game of table tennis but is also applicable to other ball games such as tennis on any type of court.

What is claimed is:

1. A device for throwing balls onto a playing area, said device being provided with ball-throwing heads comprising two pairs of rotating rollers placed in side-by-side relation, wherein means are provided for individual adjustment of the speed of rotation of each roller, wherein the rollers of each pair are spaced apart in order to form a gap which is adapted to be the diameter of the balls thrown thereby to permit each ball which is engaged within said gap to come into contact simultaneously with both rollers of each pair, wherein means are provided for conveying the balls to said gaps, said means comprising a main duct (5) connected to an air blower (4), said main duct (5) having a branch hose (47) for feeding balls to said main duct downstream of said blower (4) and being joined by the means of a Y-junction to two ducts (5*a*, 5*b*) connected to each gap of the ball-throwing heads, each duct (5*a*, 5*b*) comprising, near each gap, means (62) for arresting the balls in said ducts and for releasing said balls according to a predetermined sequence, each duct (5*a*, 5*b*) being provided between said arresting means (62) and said Y-junction with a vent (61) the dimensions of which are adapted to be smaller than the diameter of a ball (7).

2. A device according to claim 1, wherein said means (62) for arresting said balls (7) in each duct are constituted by a roller having a peripheral surface of elastic material which projects into the interior of each duct aforesaid, said roller being associated with means for initiating the rotation of said roller, said roller being capable of arresting the balls when it is stationary and of propelling them towards the ball-throwing head when the movement of rotation of said roller is initiated.

3. A device according to claim 1, wherein the ball-throwing heads are mounted on supports for adjusting the height of each ball-throwing head.

* * * * *